US007589468B2

(12) United States Patent
Hendricx

(10) Patent No.: US 7,589,468 B2
(45) Date of Patent: Sep. 15, 2009

(54) HIGH INTENSITY DISCHARGE LAMP

(75) Inventor: Josephus Christiaan Maria Hendricx, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 310 days.

(21) Appl. No.: 10/571,819

(22) PCT Filed: Sep. 10, 2004

(86) PCT No.: PCT/IB2004/051737

§ 371 (c)(1),
(2), (4) Date: Mar. 15, 2006

(87) PCT Pub. No.: WO2005/027183

PCT Pub. Date: Mar. 24, 2005

(65) Prior Publication Data

US 2007/0029916 A1 Feb. 8, 2007

(30) Foreign Application Priority Data

Sep. 17, 2003 (EP) ..... 03103412

(51) Int. Cl.
*H01J 17/16* (2006.01)

(52) U.S. Cl. ..... 313/634; 313/635; 313/636; 313/318.02; 313/318.12; 313/493

(58) Field of Classification Search ..... 313/567–643
See application file for complete search history.

(56) References Cited

U.S. PATENT DOCUMENTS 4,633,135 A * 12/1986 Akins ..... 313/594
5,541,480 A * 7/1996 Renardus et al. ..... 313/635
5,587,626 A * 12/1996 Parham et al. ..... 313/634
6,172,462 B1 * 1/2001 Gibson et al. ..... 313/594
6,538,377 B1 * 3/2003 Scott et al. ..... 313/567
6,661,171 B2 * 12/2003 Hecker ..... 313/594
2002/0060912 A1 * 5/2002 Becker et al. ..... 362/548
2004/0245901 A1 * 12/2004 Yang ..... 313/17

* cited by examiner

*Primary Examiner*—Nimeshkumar D. Patel
*Assistant Examiner*—Thomas A Hollweg

(57) ABSTRACT

A metal halide lamp is disclosed comprising an elongated discharge vessel, preferably made of a ceramic material, surrounded by an outer envelope and having a wall which encloses a discharge space containing an inert gas, such as xenon, and an ionizable filling, wherein at both ends in said discharge space an electrode is arranged between which a discharge arc can be maintained along a discharge path, wherein one end of the discharge vessel is mounted in a mounting base, said lamp comprising a band-shaped light-shielding strip extending laterally of the discharge path, and a lead-back conductor supplying current from the mounting base to the electrode at the other end of the discharge vessel, wherein, seen in cross section, the lead-back conductor is positioned within the sector defined by the two lines through the center of the discharge vessel and the edges of said strip. Also a metalhalide lamp is disclosed wherein the light-shielding strip is a conductive strip, and the antenna or the lead-back conductor is integrated with said strip. Furthermore a metalhalide lamp is disclosed wherein the lead-back wire is provided inside the wall of the outer envelope.

5 Claims, 5 Drawing Sheets

HIGH INTENSITY DISCHARGE LAMP

The invention relates to a high intensity discharge lamp comprising an elongated discharge vessel, preferably made of a ceramic material, surrounded by an outer envelope and having a wall which encloses a discharge space comprising an ionizable filling including an inert gas, such as xenon, wherein at both ends in said discharge space an electrode is arranged between which a discharge arc can be maintained along a discharge path, wherein one end of the discharge vessel is mounted in a mounting base, said lamp comprising a substantially band-shaped light-shielding strip extending laterally from the discharge path, and a lead-back conductor supplying current from the mounting base to the electrode at the other end of the discharge vessel.

Such lamps are known, and are mainly used in the automotive field, more specifically for use in headlights.

The band-shaped light-shielding strip usually extends along the length of the discharge vessel as a light absorbing coating on the wall of either the discharge vessel or the outer envelope. The light-shield achieves a light/dark boundary, which is projected many times by the multi-facet lens of the headlight assembly or by a so called "free form reflector" such that a sufficiently sharp beam delineation in the beam pattern of the headlight is provided in order to avoid radiation of light giving rise to dazzle, for example. Just below the light/dark-boundary in a dimmed beam pattern there must be a very high light intensity to lighten a road at a distance, whereas just above said light/dark boundary a very low light intensity must be present to avoid said dazzle. This is called the cut-off, which must be sharp, and in many countries must comply with prescribed standards.

The lead-back conductor is usually a wire running at some distance from the outer envelope, positioned below the horizontally extending lamp when it is fitted in a reflector. This lead-back conductor is usually shielded from the light source by an additional shield.

Some lamp types also comprise a conductive antenna extending laterally from the discharge path. The conductive antenna in such lamps usually extends along the length of the discharge vessel between electrodes and serves as a so-called ignition strip or starting antenna. The antenna capacitively couples the high voltage pulse from an electrode, through the gas filling and the wall, to the antenna, and finally to the other electrode. This reduces the apparent distance between electrodes and therefore increases the applied electric field which accelerates primary electrons and initiates the so called Townsend avalanche. This occurs when at least one secondary electron is emitted in the gas filling for each primary electron, and the discharge current becomes self-sustaining.

The drawbacks of the known lamps are that the lead-back wire and its external shield, and if present also the antenna, is partially blocking the light way and thus absorbs a lot of light, which is then not available for the beam pattern. Another drawback of the known lamps is that they may have disadvantageous effects on the light pattern which is projected by the lamp as explained above, and in particular may lead to a less sharp cut-off.

The object of the invention is to provide a lamp which is simple, compact, has a better efficiency and/or produces a better beam pattern.

In order to accomplish said object, seen in cross section, the lead-back conductor, and if present preferably also the antenna, is positioned within the sector defined by the two lines through the center of the discharge vessel and the edges of said strip. Preferably, seen in cross section, the lead-back conductor is positioned within the sector defined by the two tangent lines touching the circumference of the half-value maximum luminance distribution area of the discharge arc during operation and running through the respective nearest edges of said strip. Furthermore, the middle of the arc will not be positioned in the center of the tube, but slightly above, which is caused by convection inside the discharge vessel. The projection lines that touch the circle where the luminance is about 50% of the maximum luminance and which run through the nearest edges of the strip define the boundaries between which the lead-back conductor and the antenna should be, so that they have almost no negative impact on the projection of the strip, and the light is blocked substantially by the light shielding strip only. In an alternative definition of the preferred embodiment of the invention, said strip, the lead-back conductor and if present the antenna, are positioned roughly or substantially on one radial line through the center of the lamp, seen in cross section.

In a particular preferred embodiment the light-shielding strip is a conductive strip, preferably made of tungsten, and the antenna or the lead-back conductor is integrated with said strip. This feature can be considered as an invention on its own, and can be applied also when the remaining separate antenna or the lead-back conductor is not positioned within the sector mentioned. Not only the previously mentioned advantages are achieved hereby, but also a cost reduction and a more compact lamp can be achieved by combining two different parts to one part.

In a first preferred embodiment said strip is integrated with the antenna and is provided on the outer side of the discharge vessel.

In a second preferred embodiment said strip is integrated with the antenna and is provided on the inner side of the outer envelope.

In a third preferred embodiment said strip is integrated with the lead-back conductor and is provided on the outer side of the outer envelope.

In a fourth preferred embodiment said strip is integrated with the lead-back conductor and is provided inside the wall of the outer envelope. In a special preferred embodiment also the antenna is integrated therein, such that all three functions are integrated with one conducting strip inside said wall. In that case the conducting strip should be positioned as close as possible to the discharge vessel, in order to have a properly functioning antenna.

In this fourth embodiment the lead-back conductor is surrounded by the wall material, preferably quartz glass, of the outer envelope, which has the further advantage that it is electrically insulated thereby.

Preferably the lead back conductor, the light-absorbing strip and/or the antenna are provided with a dark or black light absorbing coating, in order to prevent light scattering.

Other combinations and positions of the strip and the antenna or the lead-back conductor as defined herein are of course possible, each having its own advantages, and those will be obvious to the man skilled in the art.

The invention also relates to a vehicle head lamp comprising a reflector and a lamp as described above mounted therein.

The above and further aspects of the lamp in accordance with the invention will now be explained with reference to lamp embodiments shown in the figures, wherein.

Figure 1:
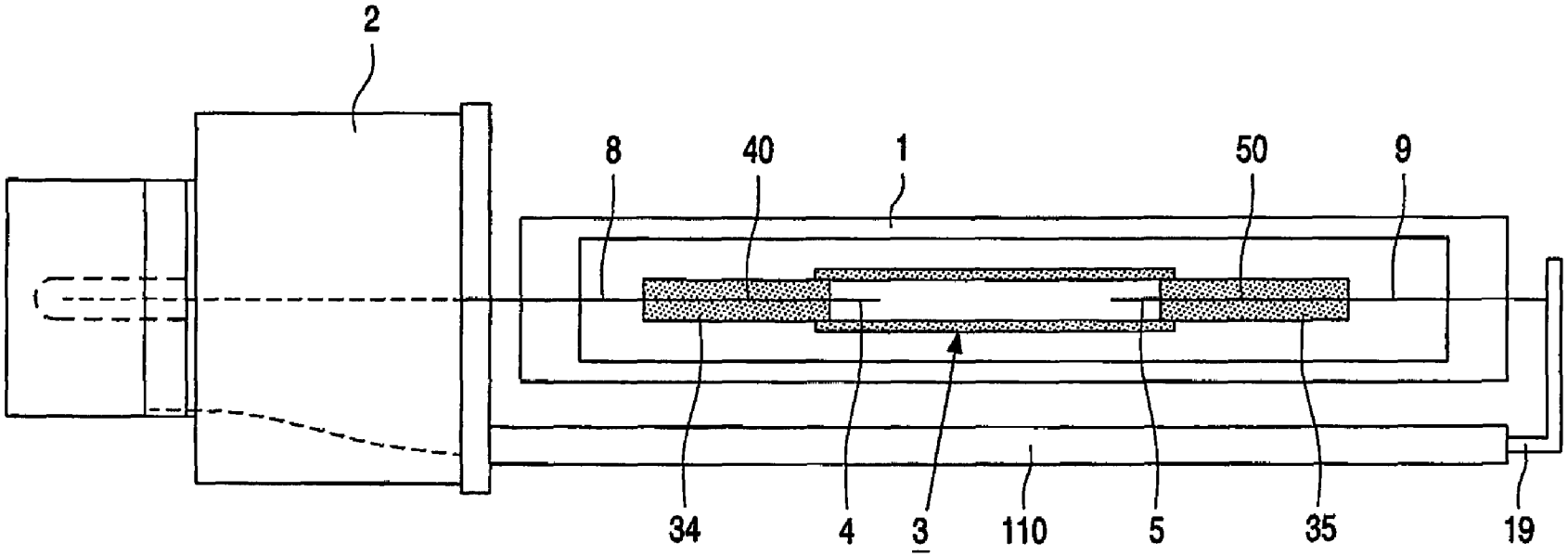
FIG. 1 shows a lamp in side elevation.

In FIG. 1 the electric discharge lamp has a tubular, light transmissive ceramic discharge vessel 3 of polycrystalline aluminum oxide, and a first and a second current conductor 40, 50 which enter the discharge vessel 3 opposite each other, and each conductor 40, 50 supports an electrode 4, 5 in the vessel 3. Said electrodes are made of tungsten and are welded to the current conductors 40, 50.

Ceramic seals 34, 35 seal the discharge vessel 3 around the current conductors 40, 50 in a gas tight manner. The discharge vessel 3 has an ionizable filling comprising xenon as a rare gas and a metal halide mixture comprising sodium and rare earth iodides. The discharge vessel 3 is surrounded by a substantial cylindrical transparent outer envelope 1.

The outer ends of current conductors 40, 50 are connected to connecting wires 8, 9 which extend outside the seals 34, 35 and through the end walls of outer envelope 1. One connecting wire 8 is connected directly to a first electric pole in mounting base 2, the other connecting wire 9 is connected to a lead back wire 19, which extends alongside the outer envelope 1 and is connected to a second electric pole in the mounting base 2. The lead back wire 19 is surrounded by a ceramic isolation shield 110.

Figure 2:
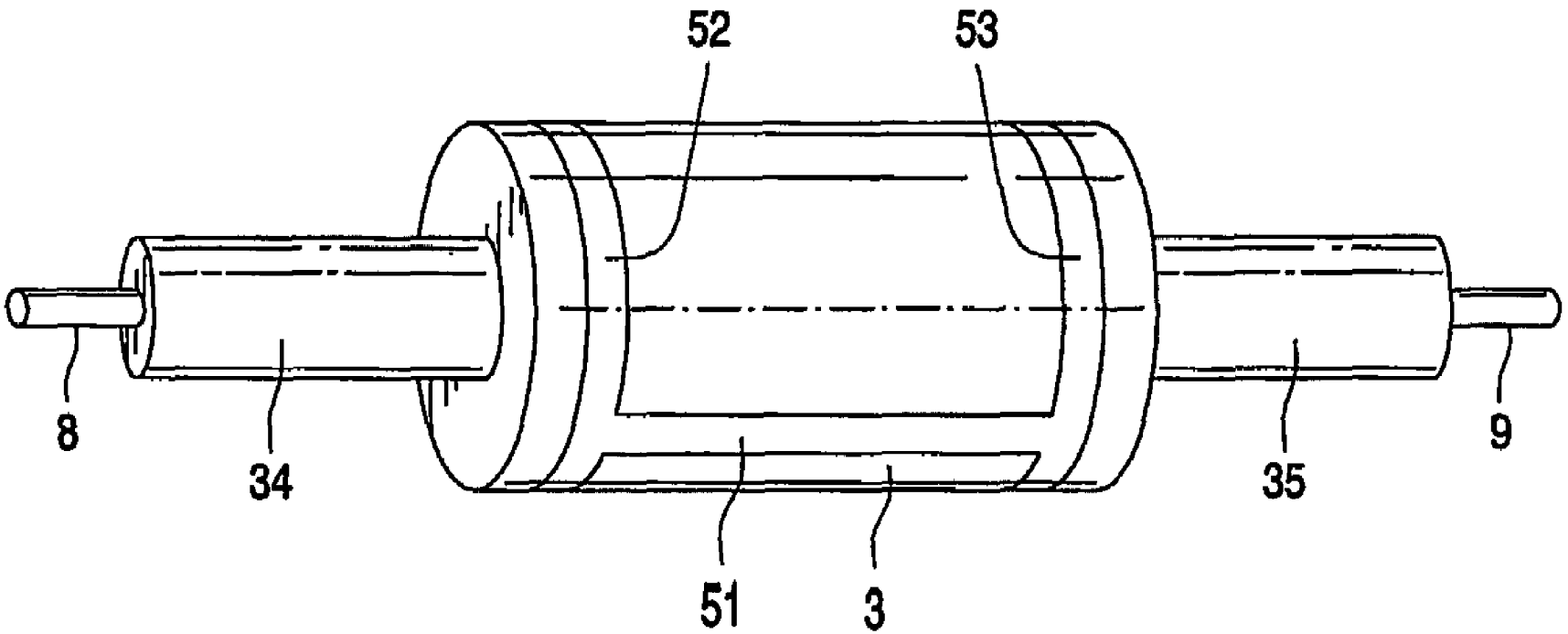
FIG. 2 shows a perspective view of a discharge vessel in the lamp.

In FIG. 2 the discharge vessel 3 is provided with a conductive antenna 51 extending along the length of the vessel 3 and connecting rings 52, 53 surrounding the electrode tips, as known from U.S. Pat. No. 5,541,480. The optional rings 52, 53 are part of the antenna The antenna reduces the breakdown voltage at which the gas filling ionizes.

Figure 3:
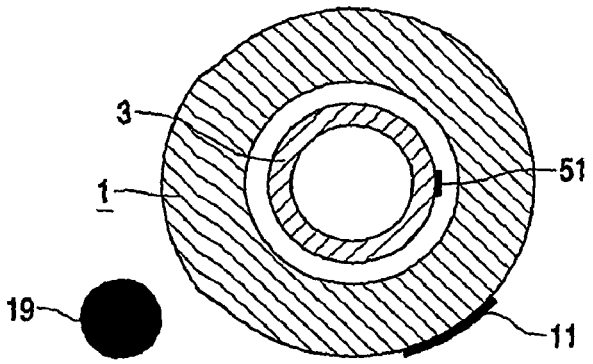
FIGS. 3-9 show cross sections of a lamp.

The cross section of the lamp in FIG. 3 shows the discharge vessel 3 surrounded by the outer envelope 1. Outside the outer envelope extends the lead back wire 19, which may be isolated by the ceramic shield 110 (not shown). In the outer side of the discharge vessel 3 is shown the antenna 51. A band-shaped light-shielding strip 11 extends along the length of the discharge vessel as a light absorbing coating as explained in the introduction.

Figure 4:
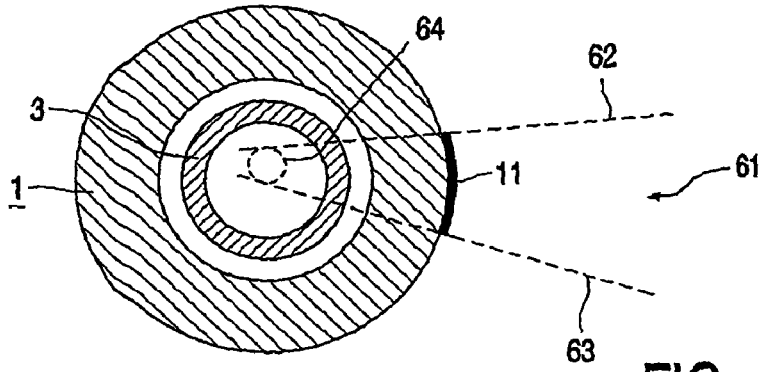
Figure 5:
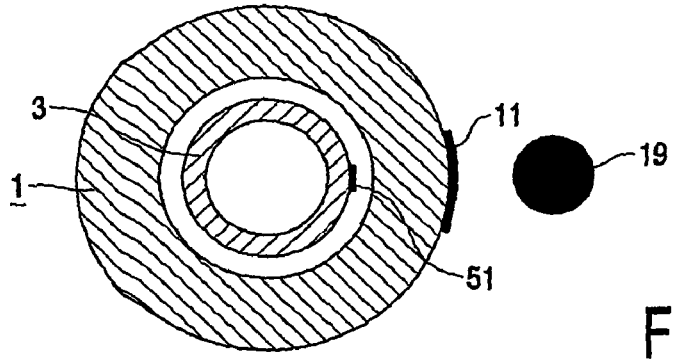

FIG. 4 shows the circumference of the half-value maximum luminance distribution area 64 of the discharge arc during operation. A sector 61 is defined by the two tangent lines 62, 63 touching the circumference of the area 64 and running through the respective nearest edges of the light-shielding strip 11. The antenna 51 and the lead back wire 19 are preferably positioned inside the sector 61, as shown for example in FIG. 5.

FIGS. 6 to 9 show particular embodiments of the lamp, wherein the tasks of the antenna 51, the light-shielding strip 11 and/or the lead back wire 19 are combined. Also in these embodiments the remaining antenna 51 and/or the lead back wire 19 are positioned inside the sector 61 shown in FIG. 4, as is preferred.

Figure 6:
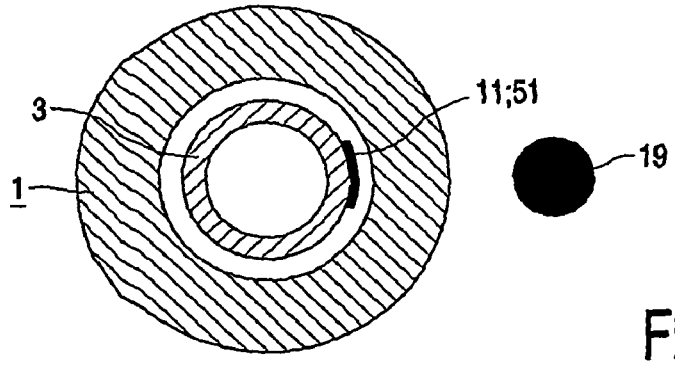

According to FIG. 6 the strip 11 is integrated with the antenna 51 and is provided on the outer side of the discharge vessel 3.

Figure 7:
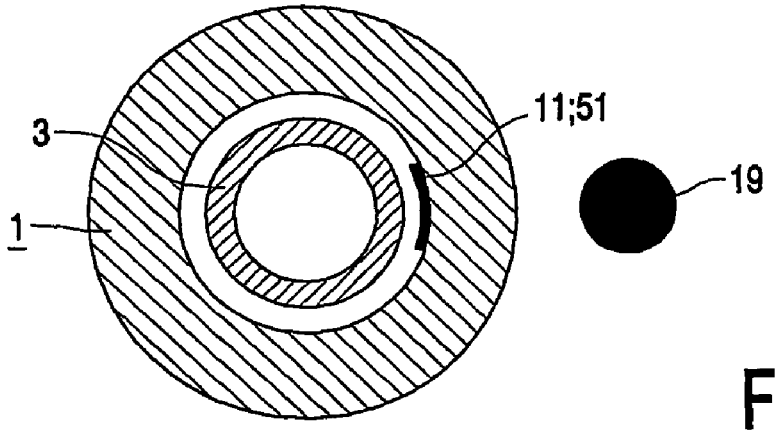

According to FIG. 7 the strip 11 is integrated with the antenna 51 and is provided on the inner side of the outer envelope 1.

Figure 8:
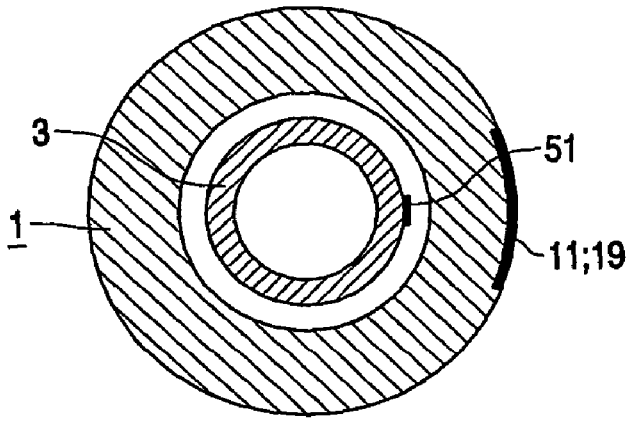

According to FIG. 8 the strip 11 is integrated with the lead-back wire 19 and is provided on the outer side of the outer envelope 1.

Figure 9:
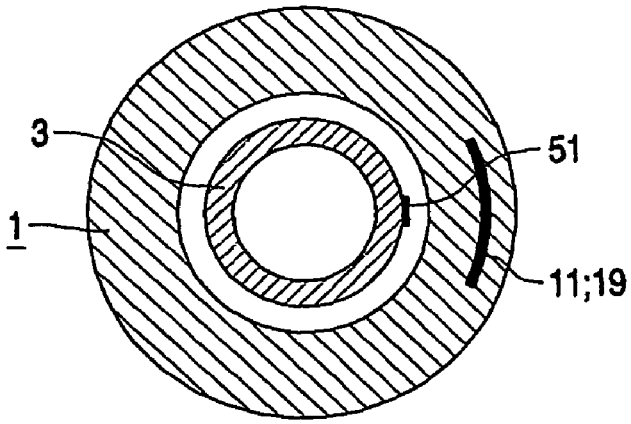

According to FIG. 9 the strip 11 is integrated with the lead-back wire 19 and is provided in the wall of the outer envelope 1.

Figure 10:
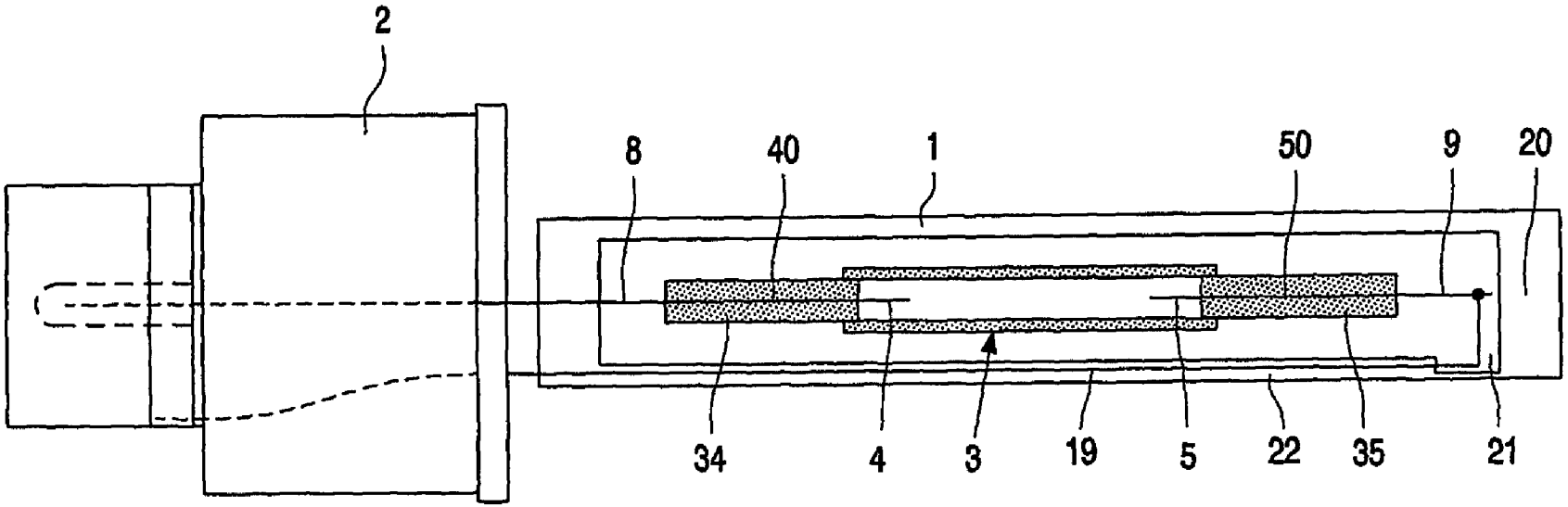
FIG. 10 shows a lamp in side elevation.

In FIG. 10, the electric discharge lamp has a tubular, light transmissive ceramic discharge vessel 3 of polycrystalline aluminum oxide, and a first and a second current conductor 40, 50 which enter the discharge vessel 3 opposite each other, and each conductor 40, 50 supports an electrode 4, 5 in the vessel 3. Said electrodes are made of tungsten and are welded to the current conductors 40, 50.

Ceramic seals 34, 35 seal the discharge vessel 3 around the current conductors 40, 50 in a gas tight manner. The discharge vessel 3 has an ionizable filling comprising xenon as a rare gas and a metal halide mixture comprising sodium and rare earth iodides. The discharge vessel 3 is surrounded by a substantial cylindrical transparent outer envelope 1.

The outer ends of current conductors 40, 50 are connected to connecting wires 8, 9 which extend outside the seals 34, 35 and through the end walls of outer envelope 1. One connecting wire 8 is connected directly to a first electric pole in mounting base 2, the other connecting wire 9 is connected to a lead back wire 19, which extends through the cylindrical side wall 22 of the outer envelope I and is connected to a second electric pole in the mounting base 2.

During manufacturing of the lamp according to FIG. 10 the envelope 1 is left open at the side of end wall 20. A recess 21 is made in the wall 22 and a bore hole is provided over the length of the wall 22. If the lead back wire 19 must act as an antenna, the bore hole should preferably located as close as possible to the inner side of the outer envelope. Lead back wire 19 is welded to connecting wire 9, and the discharge vessel 3 is then inserted in the envelope 1, while at the same time the lead back wire 19 is inserted in the bore hole in the wall 22. Finally the end wall 20 is closed by locally melting the outer envelope.

The invention claimed is:

1. A high-intensity discharge lamp comprising an elongated discharge vessel surrounded by an outer envelope and having a wall which encloses a discharge space comprising an ionizable filling including an inert gas, wherein at both ends in said discharge space an electrode is arranged between which a discharge arc can be maintained along a discharge path, wherein one end of the discharge vessel is mounted in a mounting base, said lamp comprising a substantially band-shaped light-shielding conductive strip extending laterally from the discharge oath and provided with one of the discharge vessel or the outer envelope, and a lead-back conductor supplying current from the mounting base to the electrode at the other end of the discharge vessel, characterized in that, seen in cross section, the lead-back conductor is positioned within a sector defined by two lines through a center of the discharge vessel and the edges of said strip, further comprising a conductive antenna extending laterally from the discharge oath and, seen in cross section, positioned within said sector or substantially on one radial line through the center of the discharge vessel wherein the antenna or the lead-back conductor is integrated with said strip.

2. A lamp according to claim 1 wherein said strip is integrated with the antenna and is provided on the outer side of the discharge vessel.

3. A lamp according to claim 1 wherein said strip is integrated with the antenna and is provided on the inner side of the outer envelope.

4. A high-intensity discharge lamp comprising an elongated discharge vessel surrounded by an outer envelope and having a wall which encloses a discharge space comprising an ionizable filling including an inert gas, wherein at both ends in said discharge space an electrode is arranged between which a discharge arc can be maintained along a discharge path, wherein one end of the discharge vessel is mounted in a mounting base, said lamp comprising a substantially band-shaped light-shielding conductive strip extending laterally from the discharge oath and provided with one of the discharge vessel or the outer envelope, and a lead-back conductor supplying current from the mounting base to the electrode at the other end of the discharge vessel, characterized in that, seen in cross section, the lead-back conductor is positioned within a sector defined by two lines through a center of the discharge vessel and the edges of said strip, wherein said strip is integrated with the lead-back conductor and is provided inside the wall of the outer envelope.

5. A high-intensity discharge lamp comprising an elongated discharge vessel surrounded by an outer envelope and having a wall which encloses a discharge space comprising an ionizable filling including an inert gas, wherein at both ends in said discharge space an electrode is arranged between which a discharge arc can be maintained along a discharge oath, wherein one end of the discharge vessel is mounted in a mounting base, said lamp comprising a substantially band-shaped light-shielding conductive strip extending laterally from the discharge oath and provided with one of the discharge vessel or the outer envelope, and a lead-back conductor supplying current from the mounting base to the electrode at the other end of the discharge vessel, characterized in that, seen in cross section, the lead-back conductor is positioned within a sector defined by two lines through a center of the discharge vessel and the edges of said strip, wherein said strip is integrated with the lead-back conductor and is provided on the outer side of the outer envelope.

* * * * *